US009113516B2

(12) United States Patent
Bordin et al.

(10) Patent No.: US 9,113,516 B2
(45) Date of Patent: Aug. 18, 2015

(54) DIMMABLE LED DRIVER AND METHOD FOR CONTROLLING THE SAME

(75) Inventors: Luca Bordin, München (DE); Shaoping Chen, Shenzhen (CN); Yuli Chen, Shenzhen (CN); Shijun Nie, Shenzhen (CN); Wei Tan, Shenzhen (CN)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/115,200

(22) PCT Filed: May 3, 2012

(86) PCT No.: PCT/EP2012/058090

§ 371 (c)(1),
(2), (4) Date: Jan. 15, 2014

(87) PCT Pub. No.: WO2012/152641

PCT Pub. Date: Nov. 15, 2012

(65) Prior Publication Data

US 2014/0125240 A1 May 8, 2014

(30) Foreign Application Priority Data

May 6, 2011 (CN) ..... 2011 1 0117382

(51) Int. Cl.
*H05B 37/02* (2006.01)
*H05B 33/08* (2006.01)

(52) U.S. Cl.
CPC ..... *H05B 33/0809* (2013.01); *H05B 33/0815* (2013.01); *H05B 33/0845* (2013.01)
USPC ..... 315/307; 315/247; 315/224; 315/291; 363/19; 363/23; 363/21.1; 363/21.09

(58) Field of Classification Search
CPC ..... H05B 33/0815; H05B 33/0845; H05B 33/0809; H05B 33/0851; H05B 37/02; H02M 3/1582; H02M 2001/009; Y02B 20/347; Y10S 315/04
USPC ..... 315/194, 291, 224, 247, 307, 308, 312, 315/DIG. 4; 363/19, 21.01, 21.05, 21.1, 363/21.09, 23
See application file for complete search history.

(56) References Cited

U.S. PATENT DOCUMENTS 7,649,325 B2 * 1/2010 McIntosh et al. ..... 315/291
7,804,256 B2 * 9/2010 Melanson ..... 315/291

(Continued)

FOREIGN PATENT DOCUMENTS

JP 2008-104273 5/2008
JP 2010-268676 11/2010

*Primary Examiner* — Haiss Philogene
(74) *Attorney, Agent, or Firm* — Cozen O'Connor

(57) ABSTRACT

A dimmable LED driver adapted to be operated with a dimmer that is configured to generate a predetermined conductive angle, wherein the dimmable LED driver comprises: a rectifier configured to convert an alternating current output by the dimmer to a direct current, a buck PFC block configured to adjust an output voltage of the direct current so as to obtain a stable output voltage, a second buck DC/DC block configured to realize output of a constant current after the stable output voltage is realized, a dimming block configured to, after realizing output of the constant current, accomplish a dimming function jointly with the second buck DC/DC block, and an MCU configured to control the buck PFC block, the second buck DC/DC block and the dimming block.

19 Claims, 4 Drawing Sheets

(56) References Cited

U.S. PATENT DOCUMENTS

| | | | | |
|---|---|---|---|---|
| 7,902,769 | B2 * | 3/2011 | Shteynberg et al. | 315/291 |
| 7,973,494 | B2 * | 7/2011 | Yao et al. | 315/291 |
| 8,203,276 | B2 * | 6/2012 | Shackle et al. | 315/194 |
| 8,492,987 | B2 * | 7/2013 | Nuhfer et al. | 315/246 |
| 8,587,209 | B2 * | 11/2013 | Soleno | 315/219 |
| 8,624,828 | B2 * | 1/2014 | Uchimoto et al. | 345/102 |
| 8,629,629 | B2 * | 1/2014 | Hariharan | 315/297 |
| 8,810,157 | B2 * | 8/2014 | Del Carmen, Jr. | 315/297 |
| 2007/0182338 | A1 | 8/2007 | Shteynberg et al. | |
| 2011/0080110 | A1 | 4/2011 | Nuhfer et al. | |
| 2014/0300274 | A1 * | 10/2014 | Acatrinei | 315/85 |

* cited by examiner

DIMMABLE LED DRIVER AND METHOD FOR CONTROLLING THE SAME

RELATED APPLICATIONS

This application is a U.S. National Phase Application under 35 USC 371 of International Application PCT/EP2012/058090 filed May 3, 2012.

This application claims the priority of Chinese application No. 201110117382.2 filed May 6, 2011, the entire content of which is hereby incorporated by reference.

FIELD OF THE INVENTION

The present invention relates to a dimmable LED driver and a method for controlling the dimmable LED driver.

BACKGROUND OF THE INVENTION

The LED lighting system is used more and more in current lighting devices. With the market demands and energy level regulation, dimmable LED drives with a high PF and high efficiency emerge. But the dimmable LED driving apparatus with a high performance on the market have the following problems more or less: a) a lot of control chips and complex external circuits are used to satisfy design requirements of LED driving; b) some dimmable drivers use a single stage PFC control chip, but flicker may appear thereby, and the LED will bear a significant amount of low frequency (100 Hz/120 Hz) ripple current, then, a big output capacitor is needed in order to re-duce the influence of the ripple current, which again increases the volume and cost of the entire driver and occupies a large structure space; c) the traditional BOOST PFC+DC/DC structure applied to the LED driving does not have a high efficiency, because an output therefrom is changed from a very high voltage (an output voltage from boost PFC is usually 400V) to a very low voltage. In addition, both PFC and second DC-DC need high voltage rated components, which increases the cost; d) the traditional averaging dimming will affect the optical effect and causes color temperature shift, and influences the LED luminescence quality; and e) an extensibility is lacked, and increasing new market demands, such as intelligent control and color mixing, can hardly be satisfied.

At present, there are a lot of dimmable LED driving systems on the market for solving related problems. For instance, the dimmable LED driving chip IW3610 of IWATT solves the problems of dimmer matching and frequent flicker using quite a few parts. This driving chip uses a BOOST PFC+ flyback structure, but can neither balance the situation of efficiency and high PF value, nor realize a PWM dimming. Another solution uses a single stage flyback LED driver that may realize a high PF with a low cost, for example, the dimming LED driving chip LNK306PN of Power Integration and ICL8001 of Infineon. But the LED should bear a ripple current of commercial power frequency one or two times of the rated current, which seriously affects the LED performances and frequent flicker will easily occur in dimming.

SUMMARY OF THE INVENTION

According to one aspect of the present invention, a dimmable LED driver is adapted to be operated with a dimmer configured to generate a predetermined conductive angle, wherein the dimmable LED driver comprises a rectifier configured to convert an alternating current output by the dimmer to a direct current, a buck PFC block configured to adjust an output voltage of the direct current so as to obtain a stable output voltage, a second buck DC/DC block configured to realize output of a constant current after the stable output voltage is realized, a dimming block configured to, after realizing output of the constant current, accomplish a dimming function jointly with the second buck DC/DC block, and an MCU configured to control the buck PFC block, the second buck DC/DC block and the dimming block.

The dimmable LED driver according to an embodiment of the present invention uses a double buck structure, an output voltage is reduced twice, and a higher efficiency is obtained. A current of the LED is controlled by the buck DC/DC block, a working frequency is high (>100 Khz), no low frequency ripple current flows through the LED, and there is no flicker problem due to a significant amount of low frequency ripple; moreover, a capacitor connected in parallel with the LED is quite small, which prominently reduces the cost and the volume of the entire driver. In addition, as the buck PFC block converts the AC voltage to a stable DC voltage with a quite low voltage, for the second buck DC/DC block, there is no need to use a power component with a quite high voltage, capable of reducing the cost and increasing the efficiency. Besides, a PWM dimming manner is used in the present invention, a peak value current flowing through the LED is unchanged, and the optical effect will not affected and the color temperature shift will not be produced. Further, in the dimmable LED driver according to an embodiment of the present invention, only a single control block is used to control all blocks, greatly simplifying the circuits and increasing the flexibility, and intelligence and flexibility of the control block makes the function extension become quite easy.

Preferably, the MCU adjusts a duty cycle of a PWM PFC signal that is output according to an error between a sampling value of a first sampling voltage of an output voltage of the buck PFC block and a set reference value so as to realize the output voltage (V_buck) that is stable and conforms to the reference value. As the buck PFC block converts the AC voltage to a stable DC voltage with a quite low voltage, for the second buck DC/DC block, there is no need to use a power component with a quite high voltage, capable of reducing the cost and increasing the efficiency.

Preferably, the MCU, after obtaining the stable output voltage, generates a PWM dimming signal and a PWM buck signal, controls the second buck DC/DC block according to the PWM buck signal to realize output of a constant current, controls simultaneously the dimming block according to the PWM dimming signal, and realizes a dimming function jointly with the second buck DC/DC block. In such a PWM dimming manner, the peak value current flowing through the LED is unchanged, the optical effect will not be affected and the color temperature shift will not be produced.

According to an embodiment of the present invention, the MCU comprises an ADC, a CPU, a PWM PFC unit, a PWM buck unit, a PWM dimming unit and a comparator unit, wherein the ADC is connected to an input end of the CPU, and output ends of the CPU are connected with input ends of the PWM PFC unit, the PWM buck unit and the PWM dimming unit, while the other input end of the PWM buck unit is connected with an output end of the comparator unit. By controlling all blocks with only a single control block, the circuits are greatly simplified and the flexibility is increased; moreover, intelligence and flexibility of the control block makes the function extension become quite easy.

According to an embodiment of the present invention, the buck PFC block comprises a first MOSFET, a first MOSFET driver, a first filter inductor, a second diode, a first energy storage capacitor, a third resistor and a fourth resistor, wherein the first MOSFET driver has an input end connected to the PWM PFC unit and an output end connected to a gate of the first MOSFET, a drain electrode of the first MOSFET is connected to a live wire output end of the rectifier through the first diode, and wherein the first diode has an anode connected to the live wire output end of the rectifier and a cathode connected to a drain electrode of the first MOSFET, one end of the first filter inductor and a cathode of the second diode are connected to a source electrode of the first MOSFET, the other end of the first filter inductor is connected with one end of the first energy storage capacitor and one end of the third resistor to be connected with an anode of the LED, wherein the other end of the third resistor is connected in series with the fourth resistor, and a first pin that is connected to the ADC is provided between the third resistor and the fourth resistor, and wherein the anode of the second diode is connected with the other end of the first energy storage capacitor and the other end of the fourth resistor to be grounded together. The MCU controls on and off of the first MOSFET through the first MOSFET driver using the PWM PFC signal so as to chop an input voltage, and the MCU receives a first sampling voltage fed back from the first pin. The first sampling voltage, after divided by the third and fourth resistors, is fed back to the ADC of the MCU. A stable output voltage is obtained through this buck PFC block.

According to an embodiment of the present invention, the MCU only adjusts the duty cycle of the PWM PFC signal at a time of each zero-crossing of an AC voltage so as to make sure that the duty cycle keeps constant in each half AC cycle. It can be known from the formula $$I_{Lpk} = \frac{(v_{in} - v_0) \cdot T_{on}}{L}$$

that, as an output voltage Vo and an inductance quantity L are constant, a peak value current ILpk on the inductor will be approximately proportional to an input voltage Vin as long as the on-time Ton of the MOSFET keeps constant, so to as make the input current follow the input voltage to realize PFC and to obtain a high power factor.

According to an embodiment of the present invention, the second buck DC/DC block comprises a third diode, a second MOSFET, a second MOSFET driver, a second filter inductor, a fifth resistor and a sixth resistor, wherein the second MOSFET driver has an input end connected to the PWM buck unit through the sixth resistor and an output end connected to a gate of the second MOSFET, the second MOSFET has a drain electrode connected to the anode of the third diode and a cathode connected to an anode of the LED, through the second filter inductor, a source electrode of the second MOSFET is connected with one end of the fifth resistor and an in-phase input end of the comparator unit, respectively, a reversed-phase input end of the comparator unit is connected with a reference voltage, and the other end of the fifth resistor is grounded, and wherein the second buck DC/DC block works in a peak current mode. A constant output current is obtained through this second buck DC/DC block.

According to an embodiment of the present invention, the MCU controls the PWM buck signal to output a high level and controls the second MOSFET to be turned on, a state of the comparator unit turns over when the second sampling voltage on the fifth resistor reaches the reference voltage, and the PWM buck signal is triggered to output a low level. Thus, a linkage between the comparator unit and the second buck DC/DC block enables the peak value of a current flowing through the LED to be controlled at a predetermined value.

According to an embodiment of the present invention, the dimming block comprises the first and second resistors, and the fourth diode. The first and second resistors are connected in series between the live wire output end and a zero line output end of the rectifier, the other end of the second resistor is grounded jointly with the zero line output end, a second pin that is connected to the ADC is provided between the first and second resistors, and the fourth diode has a cathode connected to the PWM dimming unit and an anode connected between the sixth resistor and the second MOSFET driver. The AC volt-age is rectified by the rectifier and is guided into the MCU through the second pin, and a conductive angle of the dimmer is calculated by the MCU. The MCU generates one channel of PWM dimming signal through the PWM dimming unit and adjusts a duty cycle of the PWM dimming signal according to the conductive angle. The PWM dimming signal is output to the second MOSFET driver through the fourth diode so as to control on and off of the second MOSFET. When the PWM dimming signal has a high level, the fourth diode is not turned on, the signal does not affect the second MOSFET driver, and the second buck DC/DC block outputs a current normally. When the PWM dimming signal has a low level, the fourth diode is turned on, a level of the second MOSFET driver is drawn low, the second buck DC/DC block stops working, and an output current is zero.

Preferably, the duty cycle of the PWM dimming signal is calculated from a function D=f(Θ). Optionally, the duty cycle of the PWM dimming signal is obtained in a manner of looking for a preset comparison table of conductive angel with duty cycle. When the conductive angle changes, the PWM dimming signal changes correspondingly, and the time when the fourth diode is turned off also changes correspondingly, further causing light and shade of a beam output from the LED changes so as to realize dimming.

According to another aspect of the present invention, a method for controlling an LED dimmer of the above type includes the following steps: a) initializing a system and activating all function blocks of the LED dimmer; b) controlling a duty cycle of a PWM PFC signal of a buck PFC block through an MCU so as to realize a stable output voltage; and c) controlling a second buck DC/DC block through the MCU so as to realize control to output of a constant current, and simultaneously, controlling a dimming block and the second buck DC/DC block through the MCU so as to realize dimming. With application of the method, the LED is enabled not be affected by the ripple current as much as possible and the flicker phenomenon is eliminated from an output beam thereof, while the LED is dimmed. Moreover, the LED driver is enabled to have a high efficiency and power factor.

According to an embodiment of the method in the present invention, in step b), a first sampling voltage of the output voltage fed back is analyzed through the MCU. If the sampling value of the first sampling voltage conforms to a set reference value, carry out step c); otherwise, adjust the duty cycle of the PWM PFC signal that is output until a stable output voltage is obtained.

Further in step c), a second sampling voltage and a reference voltage are compared through the MCU to enable a peak value current flowing through the LED to be controlled at a predetermined value.

And further, in step c) a voltage, after rectified by a rectifier, is divided and sampled by the MCU to calculate a conductive angle of the dimmer and to send a PWM dimming signal to dim the LED.

BRIEF DESCRIPTION OF THE DRAWINGS

The drawings constitute a portion of the Description for further understanding of the present invention. These drawings illustrate the embodiments of the present invention and explain the embodiments together with the Description. In the drawings.

DETAILED DESCRIPTION OF THE DRAWINGS

Figure 1:
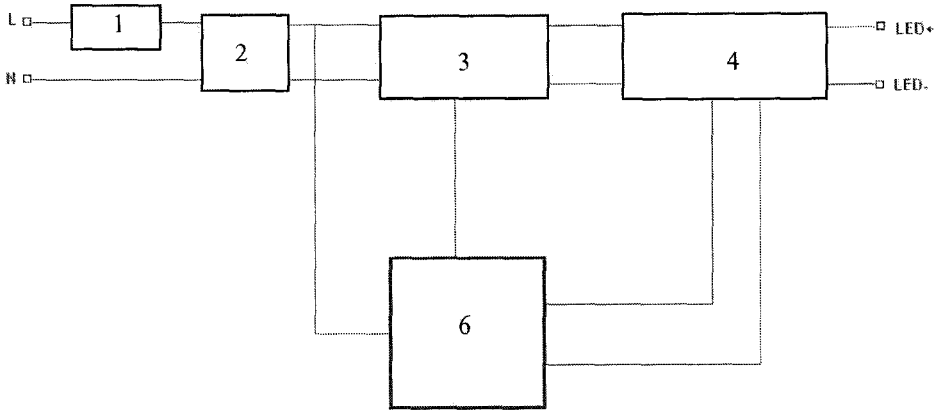
FIG. 1 is a schematic block of a dimmable LED driver according to an embodiment of the present invention.

FIG. 1 is a schematic block of a dimmable LED driver according to the present invention. It can be seen from FIG. 1 that the dimmable LED driver comprises a dimmer 1, a rectifier 2 designed to be a bridge rectifier, a buck PFC block 3, a second buck DC/DC block 4, a dimming block 5 and an MCU 6. In this dimmable LED driver, an output end of the dimmer 1 is connected to a live wire input end of the bridge rectifier 2, an output end of the bridge rectifier 2 is connected to the buck PFC block 3, an output end of the buck PFC block 3 is connected with an input end of the second buck DC/DC block 4, and an output end of the second buck DC/DC block 4 is connected with an LED. In addition, an input end of the MCU 6 is connected to a live wire output end of the bridge rectifier 2 so as to determine a conductive angle Θ of the dimmer 1, and output ends of the MCU 6 are connected with the buck PFC block 3, second buck DC/DC block 4 and a dimming block 5, respectively.

Figure 2:
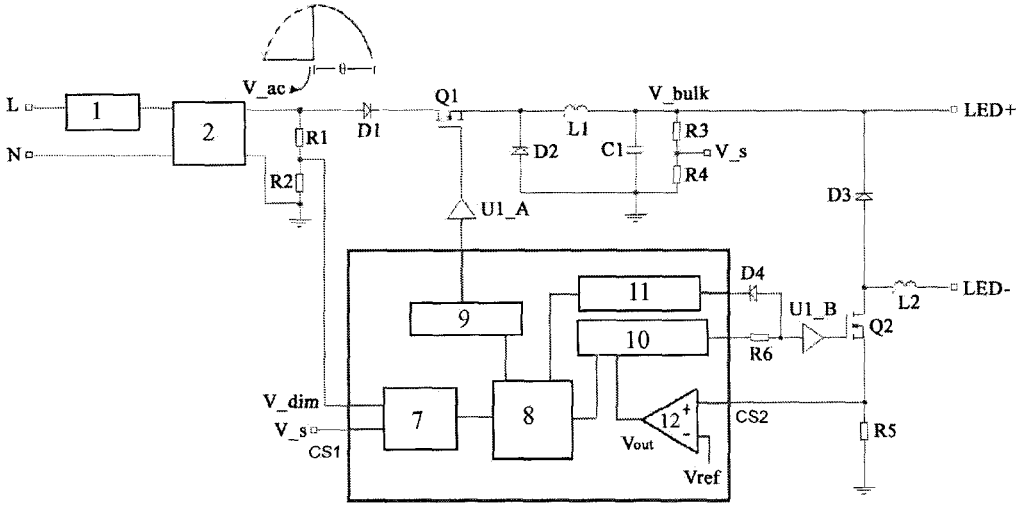
FIG. 2 is a circuit diagram of a dimmable LED driver according to an embodiment of the present invention.

FIG. 2 is a circuit diagram of a dimmable LED driver according to the present invention. It can be seen from the figure that the MCU 6 comprises an ADC 7, a CPU 8, a PWM PFC unit 9, a PWM buck unit 10, a PWM dimming unit 11 and a comparator unit 12. The ADC 7 is connected to an input end of the CPU 8, and output ends of the CPU 8 are connected with input ends of the PWM PFC unit 9, the PWM buck unit 10 and the PWM dimming unit 11, while the other input end of the PWM buck unit 10 is connected with an output end (V_out) of the comparator unit 12.

The buck PFC block 3 is formed by a first MOSFET Q1, a first MOSFET driver U1_A, a first filter inductor LI, a second diode D2, a first energy storage capacitor CI, a third resistor R3 and a fourth resistor R4 in FIG. 2. The first MOSFET driver U1_A has an input end connected to the PWM PFC unit 9 and an output end connected to a gate of the first MOSFET Q1, a drain electrode of the first MOSFET Q1 is connected to the live wire output end of the rectifier 2 through the first diode D1, and wherein the first diode D1 has an anode connected to the live wire output end of the rectifier 2 and a cathode connected to the drain electrode of the first MOSFET Q1, and the live wire input end of the rectifier 2 is connected to the output end of the dimmer 1. One end of the first filter inductor LI and a cathode of the second diode D2 are connected to a source electrode of the first MOSFET (Q1), the other end of the first filter inductor LI is connected with one end of the first energy storage capacitor CI and one end of the third resistor R3 to be connected with an anode of the LED, wherein the other end of the third resistor R3 is connected in series with the fourth resistor R4, and a first pin Pin V_s that is connected to the ADC 7 is provided between the third resistor R3 and the fourth resistor R4, and wherein the cathode of the second diode D2 is connected with the other end of the first energy storage capacitor CI and the other end of the fourth resistor R4 to be grounded together.

The buck PFC block 3 controlled by the MCU 6 is configured to realize a PFC function. Moreover, as the traditional phase-cut dimmers are specifically designed for the pure resistive load, such as incandescent lamp, they are not adapted to the capacitive load such as LED driving. The buck PFC block 3 is capable of making an input property of the LED driving approach a resistive load so as to be well compatible with the dimmer. The MCU 6 outputs one PWM PFC signal PWM_PFC and controls on and off of the first MOSFET Q1 through the first MOSFET driver U1_A so as to accomplish a buck chopping to an input voltage. An output voltage V_buck of the buck PFC block 3, after divided by the third and fourth resistors R3 and R4, is fed back to the ADC 7 of the MCU 6 through the first pin Pin V_s to be sampled. The MCU 6 adjusts a duty cycle of the output PWM PFC signal PWM_PFC according to an error between a sampling value and a set reference value so as to stabilize the output voltage. The MCU 6 only adjusts the duty cycle at a time of each zero-crossing of an AC voltage so as to make sure that the duty cycle keeps constant in each half AC cycle.

The second buck DC/DC block 4 is formed by a third diode D3, a second MOSFET Q2, a second MOSFET driver U1_B, a second filter inductor L2, a fifth resistor R5 and a sixth resistor R6 in FIG. 2. The second MOSFET driver U1_B has an input end connected to the PWM buck unit 10 through the sixth resistor R6 and an output end connected to a gate of the second MOSFET Q2, a drain electrode of the second MOSFET Q2 is connected to the anode of the third diode D3, a cathode of the third diode D3 is connected to the anode of the LED, and the anode of the third diode D3 is connected to the cathode of the LED through the second filter inductor L2, a source electrode of the second MOSFET Q2 is connected with one end of the fifth resistor R5 and an in-phase input end $V_A$ of the comparator unit 12, a reversed-phase input end $V_B$ of the comparator unit 12 is connected with a reference voltage Vref, and the other end of the fifth resistor R5 is grounded.

Figure 6:
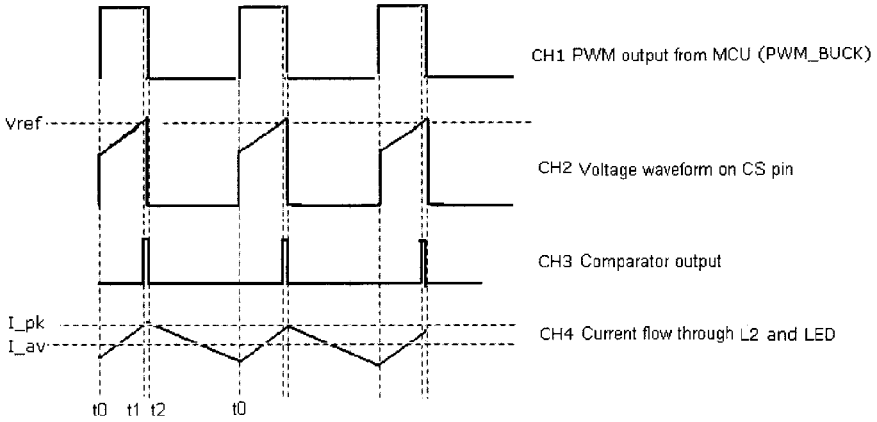
FIG. 6 is an operating waveform diagram of a second buck DC/DC block.

The second buck DC/DC block 4 controlled by the MCU 6 is configured to control of the LED to output a constant current. The second buck DC/DC block 4 works in a peak current mode, and its working waveform is as shown in FIG. 6. At a time of tO, the MCU 6 controls a PWM buck signal PWM_BUCK to output a high level, the second MOSFET Q2 is turned on (CHI, FIG. 6), a voltage line type on a second sampling voltage (CS2, FIG. 1) on the fifth resistor R5 ascends (CH2, FIG. 6), a state of the comparator unit 12 turns over (t1, CH3, FIG. 6) when the second sampling voltage CS2 reaches the reference voltage Vref, and the PWM buck signal PWM_BUCK (t2, CHI, FIG. 6) is triggered to output a low level. Thus, a linkage between the comparator unit 12 and the second buck DC/DC block 4 enables the peak value of a current flowing through the LED to be controlled at a predetermined value Vref/R5. A current waveform flowing through the LED is as shown by CH4, in which I_pk is a controlled peak value current, and I_av is an aver-age current flowing through the LED.

A dimming block is formed by the first and second resistors R1 and R2, and the fourth diode D4 in FIG. 2. The first and second resistors R1 and R2 are connected in series between the live wire output end and a zero line output end of the rectifier 2, the other end of the second resistor R2 is grounded together with the zero line output end, a second pin Pin V_dim that is connected to an ADC 7 is provided between the first and second resistors R1 and R2, and the fourth diode D4 has a cathode connected to the PWM dimming unit 11 and an anode connected between the sixth resistor and the second MOSFET driver U1_B.

Figure 4:
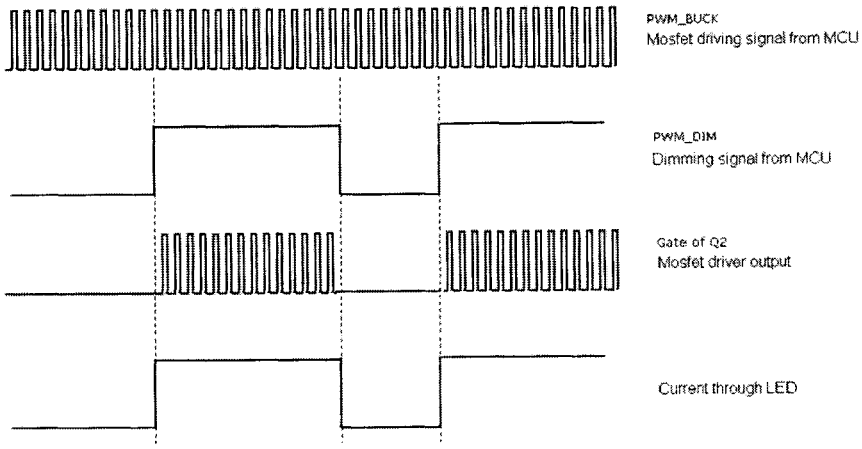
FIG. 4 is a time sequence diagram of dimming of a dimmable LED driver according to an embodiment of the present invention.
Figure 5:
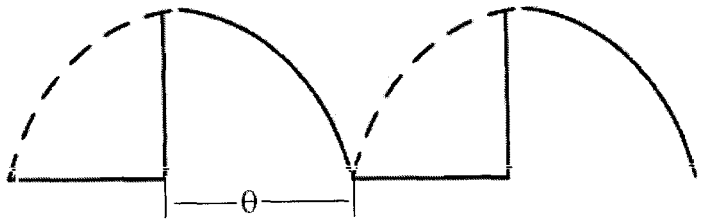
FIG. 5 is a waveform diagram of a voltage divided by a first and a second resistors.

The AC voltage rectified by the rectifier 2 is transmitted to the second pin Pin V_dim through the first and second resistors R1 and R2. A waveform of this pin is as shown in FIG. 5. Portions of broken lines in the figure represent parts of the AC voltage cut off by the phase-cut dimmer 1. The MCU 6 determines a conductive angle Θ of the dimmer 1 by analyzing the first sampling voltage CS1. Thereafter, the MCU 6 generates one channel of PWM dimming signal PWM_DIM to carry out dimming. A duty cycle of the PWM dimming signal PWM_DIM can be calculated from a function D=f(Θ) defined by software, and also may be obtained in a manner of looking for a preset table (conductive angel 9→duty cycle). The PWM dimming signal PWM_DIM is connected with the second MOSFET driver U1_B through the fourth diode D4 so as to realize a PWM dimming function. When the PWM dimming signal PWM_DIM has a high level, the fourth diode D4 is not turned on, the PWM dimming signal PWM_DIM does not affect an input signal of the second MOSFET driver U1_B, the second buck DC/DC block 4 works normally, and the LED outputs a current normally; when the PWM dimming signal PWM_DIM has a low level, the fourth diode D4 is turned on, a level at the input end of the second MOSFET driver U1_B is drawn low, the converter of the second buck DC/DC block 4 stops working, and the LED current drops to zero. Thus, the PWM dimming signal PWM_DIM controls the second buck DC/DC block 4 so as to control the output current of the LED. A time sequence of the PWM dimming is as shown in FIG. 4.

Figure 3:
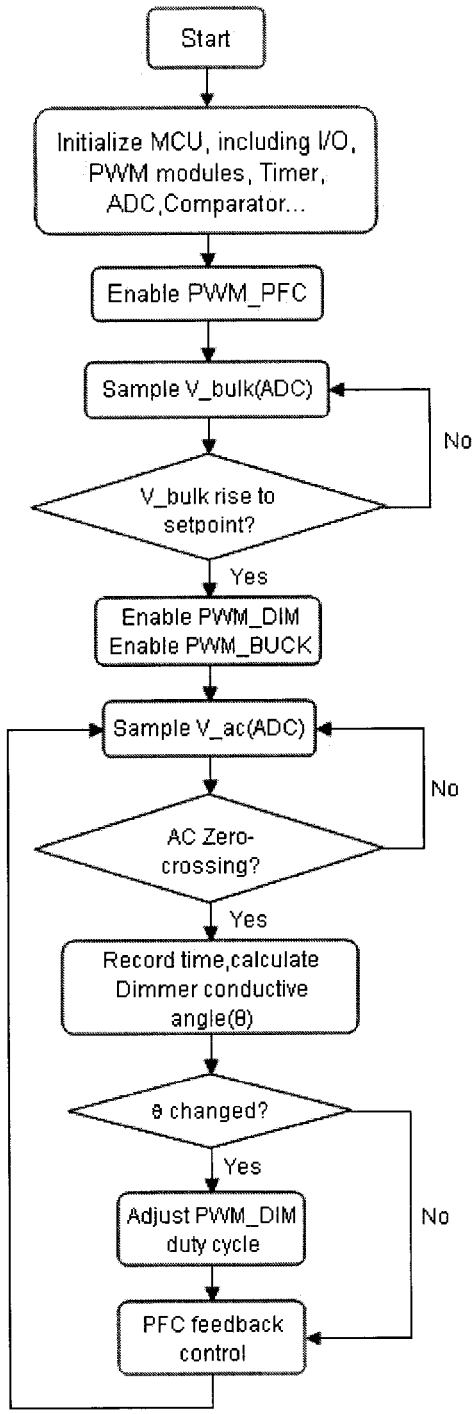
FIG. 3 is a flowchart of a controlling method according to an embodiment of the present invention.

FIG. 3 is a flowchart of a controlling method according to the present invention. The controlling method according to the present invention will be described in detail with reference to the flowchart. In the method according to the present invention, firstly a dimmable LED driver according to the present invention is enabled, and all function blocks are initialized, including a dimmer 1, a rectifier 2, a buck PFC block 3, a second buck DC/DC block 4, a dimming block 5 and an MCU 6. Consequently, the MCU 6 outputs a PWM PFC signal PWM_PFC through a PWM PFC unit 9, samples an output voltage V_buck of an output end of the buck PFC block 3 and analyzes whether a sampling value of the output voltage V_buck conforms to a set reference value. If the sampling value does not conform to the set reference value, a duty cycle of the output PWM PFC signal PWM_PFC is adjusted until a stable output voltage V_buck is obtained. If the sampling value conforms to the set reference value, the MCU 6 controls a PWM dimming unit 11 to send a PWM dimming signal PWM_DIM and controls a PWM buck unit 10 to send a PWM buck signal PWM_BUCK. And then, the MCU 6 receives a first sampling voltage CS1 fed back, and confirms whether the sampling is carried out at a time of zero-crossing of an AC voltage. If not, a sampling is carried out again. If yes, the time of zero-crossing is recorded and a conductive angle Θ of the dimmer 1 is calculated. Subsequently, the MCU 6 determines whether the conductive angle Θ detected changes or not. If not, a PFC feedback control is performed and it returns to the step of sampling the output voltage V_buck. If yes, the duty cycle of the PWM dimming signal PWM_DIM is adjusted so as to dim the LED.

The above is merely a description of preferred embodiments of the present invention but is not intended to in any way limit the present invention. For the person skilled in the art, the present invention may have various alterations and changes. Any alterations, equivalent substitutions, improvements, within the spirit and principle of the present invention, should be covered in the protection scope of the present invention as defined by the following claims.

The invention claimed is:

1. A dimmable LED driver adapted to be operated with a dimmer that is configured to generate a predetermined conductive angle, wherein the dimmable LED driver comprises:

a rectifier configured to convert an alternating current output by the dimmer to a direct current, a buck PFC block configured to adjust an output voltage of the direct current so as to obtain a stable output voltage, a second buck DC/DC block configured to realize output of a constant current after the stable output voltage is realized, a dimming block configured to, after realizing output of the constant current, accomplish a dimming function jointly with the second buck DC/DC block, and an MCU configured to control the buck PFC block, the second buck DC/DC block and the dimming block.

2. The dimmable LED driver according to claim 1, wherein the MCU adjusts a duty cycle of a PWM PFC signal that is output according to an error between a sampling value of a first sampling voltage of an output voltage of the buck PFC block and a set reference value so as to realize the output voltage that is stable and conforms to the reference value.

3. The dimmable LED driver according to claim 2, wherein the MCU, after obtaining the stable output voltage, generates a PWM dimming signal and a PWM buck signal, controls the second buck DC/DC block according to the PWM buck signal to realize output of a constant current, controls simultaneously the dimming block according to the PWM dimming signal, and realizes a dimming function jointly with the second buck DC/DC block.

4. The dimmable LED driver according to claim 1, wherein the MCU comprises an ADC, a CPU, a PWM PFC unit, a PWM buck unit, a PWM dimming unit and a comparator unit, and wherein the ADC is connected to an input end of the CPU, and output ends of the CPU are connected with input ends of the PWM PFC unit, the PWM buck unit and the PWM dimming unit, while the other input end of the PWM buck unit is connected with an output end of the comparator unit.

5. The dimmable LED driver according to claim 4, wherein the buck PFC block comprises a first MOSFET, a first MOSFET driver, a first filter inductor, a second diode, a first energy storage capacitor, a third resistor and a fourth resistor, and wherein the first MOSFET driver has an input end connected to the PWM PFC unit and an output end connected to a gate of the first MOSFET, a drain electrode of the first MOSFET is connected to a live wire output end of the rectifier through the first diode, and wherein the first diode has an anode connected to the live wire output end of the rectifier and has a cathode connected to a drain electrode of the first MOSFET, one end of the first filter inductor and the cathode of the second diode are connected to a source electrode of the first MOSFET, the other end of the first filter inductor is connected with one end of the first energy storage capacitor and one end of the third resistor to be connected with an anode of the LED, and wherein the other end of the third resistor is connected in series with the fourth resistor, and a first pin that is connected to the ADC is provided between the third resistor and the fourth resistor, and wherein the other end of the second diode is connected with the anode of the first energy storage capacitor and the other end of the fourth resis-tor to be grounded together.

6. The dimmable LED driver according to claim 5, wherein the MCU controls on and off of the first MOSFET through the first MOSFET driver using the PWM PFC sig-nal, and the MCU receives a first sampling voltage fed back from the first pin.

7. The dimmable LED driver according to claim 6, wherein the MCU only adjusts the duty cycle of the PWM PFC signal at a time of each zero-crossing of an AC voltage.

8. The dimmable LED driver according to claim 4, wherein the second buck DC/DC block comprises a third diode, a second MOSFET, a second MOSFET driver, a second filter inductor, a fifth resistor and a sixth resistor, and wherein the second MOSFET driver has an input end connected to the PWM buck unit through the sixth resistor and an output end connected to a gate of the second MOSFET, a drain electrode of the second MOSFET is connected to an anode of the third diode, and a cathode of the third diode is connected to an anode of the LED, an anode of the third diode is connected to a cathode of the LED through the second filter inductor, a source electrode of the second MOSFET is con-nected with one end of the fifth resistor and an in-phase input end of the comparator unit, respectively, a reversed-phase input end of the comparator unit is connected with a reference voltage, and the other end of the fifth resistor is grounded.

9. The dimmable LED driver according to claim 8, wherein the MCU generates the PWM buck signal to control the second MOSFET to be turned on, a state of the comparator unit turns over when the second sampling voltage on the fifth resistor reaches the reference voltage.

10. The dimmable LED driver according to claim 9, wherein the second buck DC/DC block works in a peak current mode.

11. The dimmable LED driver according to claim 8, wherein the dimming block comprises the first and second resistors, and the fourth diode, the first and second resistors are connected in series between the live wire output end and a zero line output end of the rectifier, the other end of the second resistor is grounded jointly with the zero line output end, a second pin that is connected to the ADC is provided be-tween the first and second resistors, and the fourth diode has a cathode connected to the PWM dimming unit and an anode connected between the sixth resistor and the second MOSFET driver, and wherein the AC voltage is rectified by the rectifier and is guided into the MCU through the second pin, and the conductive angle of the dimmer is calculated by the MCU.

12. The dimmable LED driver according to claim 11, wherein the MCU generates one channel of PWM dimming signal through the PWM dimming unit and adjusts a duty cycle of the PWM dimming signal according to the conductive angle, the PWM dimming signal is output to the second MOSFET driver through the fourth diode so as to control on and off of the second MOSFET.

13. The dimmable LED driver according to claim 12, wherein the duty cycle of the PWM dimming signal is calculated from a function D=f.

14. The dimmable LED driver according to claim 12, wherein the duty cycle of the PWM dimming signal is obtained in a manner of looking for a preset comparison table of conductive angel with duty cycle.

15. A method for controlling an LED dimmer, wherein the method includes the steps of:

a) initializing a system;

b) controlling a duty cycle of a PWM PFC signal of a buck PFC block through an MCU so as to realize a stable output voltage; and c) controlling a second buck DC/DC block through the MCU so as to realize control to output of a constant current, and simultaneously, controlling a dimming block and the second buck DC/DC block through the MCU to realize dimming.

16. The method according to claim 15, wherein in step b), a first sampling voltage of the output voltage fed back is analyzed through the MCU, if a sampling value of the first sampling voltage conforms to a set reference value, carry out step c); otherwise, adjust the duty cycle of the PWM PFC signal that is output.

17. The method according to claim 16, wherein in step c), a second sampling voltage and a reference voltage are compared through the MCU to enable a peak value current flowing through the LED to be controlled at a predetermined value.

18. The method according to claim 16, wherein in step c), a voltage, after rectified by a rectifier, is divided and sampled by the MCU to calculate a conductive angle of the dimmer and to send a PWM dimming signal to dim the LED.

19. The method according to claim 18, wherein in step c), if the conductive angle changes, the duty cycle of the PWM dimming signal is adjusted.

* * * * *